US007389069B2

(12) United States Patent
Yoshino et al.

(10) Patent No.: US 7,389,069 B2
(45) Date of Patent: Jun. 17, 2008

(54) IMAGE FORMING APPARATUS AND PROCESS CARTRIDGE UNIT THEREFORE

(75) Inventors: Kaoru Yoshino, Tokyo (JP); Hiroshi Ono, Tokyo (JP); Takeshi Shintani, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 137 days.

(21) Appl. No.: 11/262,787

(22) Filed: Nov. 1, 2005

(65) Prior Publication Data

US 2006/0110184 A1 May 25, 2006

(30) Foreign Application Priority Data

Nov. 1, 2004 (JP) ..... 2004-317969

(51) Int. Cl.
*G03G 15/00* (2006.01)
*G03G 21/16* (2006.01)

(52) U.S. Cl. ..... 399/167; 399/111

(58) Field of Classification Search ..... 399/25, 399/111, 113, 167
See application file for complete search history.

(56) References Cited

U.S. PATENT DOCUMENTS 5,740,503 A * 4/1998 Nakamura ..... 399/167
6,016,416 A * 1/2000 Kitamura ..... 399/167
6,125,253 A * 9/2000 Tashima et al. ..... 399/167
6,463,234 B2 * 10/2002 Arimitsu et al. ..... 399/113
6,704,529 B2 * 3/2004 Noh ..... 399/167
6,751,428 B2 * 6/2004 Okabe ..... 399/111
6,810,224 B2 * 10/2004 Ahn ..... 399/167
6,879,792 B2 * 4/2005 Carter et al. ..... 399/113
6,885,837 B2 * 4/2005 Matsubara ..... 399/167
7,031,642 B2 * 4/2006 Abe ..... 399/167
7,162,181 B2 * 1/2007 Maeshima et al. ..... 399/111 X
2003/0091366 A1 * 5/2003 Saito et al. ..... 399/111

FOREIGN PATENT DOCUMENTS

JP 8-339153 12/1996

OTHER PUBLICATIONS

U.S. Appl. No. 11/520,684, filed Sep. 14, 2006, Yoshino et al.
U.S. Appl. No. 11/855,353, filed Sep. 14, 2007, Shintani et al.

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image forming apparatus includes a unit including at least two rotary members, and an apparatus main body configured to detachably mount the unit. The apparatus main body includes a first rotation drive source, drive rotary members corresponding to the at least two rotary members and engaging with the at least two rotary members, directly or indirectly, to rotate the at least two rotary members, respectively, and a drive force transmission mechanism transmitting a drive force of the first rotation drive source to the drive rotary members.

7 Claims, 10 Drawing Sheets

IMAGE FORMING APPARATUS AND PROCESS CARTRIDGE UNIT THEREFORE

CROSS-REFERENCE TO RELATED APPLICATIONS

The present application claims priority and contains subject matter related to Japanese Patent Application No. 2004-317969 filed in the Japanese Patent Office on Nov. 1, 2004, the entire contents of which are hereby incorporated herein by reference.

BACKGROUND OF THE INVENTION

1. Field of the Invention

The present invention relates to an image forming apparatus using electrophotography, such as a copier, a printer, a facsimile apparatus, etc. and a process cartridge to be installed in the image forming apparatus, and in particular relates to a process cartridge unit that can be detachable relative to the main body of an image forming apparatus and an image forming apparatus provided with a mechanism to transmit a driving force to the process cartridge unit.

2. Discussion of the Background

Recently, a process cartridge unit in which process devices, such as, a photoconductor, a charging device, a development device, a cleaning device, etc, are integrated is used in an image forming apparatus in a detachable manner to reduce the size of the apparatus and to facilitate maintenance of the apparatus.

Japanese Patent Laid-open publication No. 8-339153 describes a process cartridge unit including an electrophotographic photoconductor and a developer bearing member. A drum gear is provided to an end part of the photoconductor to engage with a drive gear of the main body of an image forming apparatus, a sleeve gear is provided to an end part of the developer bearing member to engage with the drum gear of the photoconductor, and the sleeve gear of the developer bearing member is engaged with gears of other rotary members (a toner stirring member, etc.) via a gear row.

Thus, in the process cartridge unit described in the above-described JP publication, drive forces for all rotary members in the process cartridge unit are obtained from the side of the main body of the image forming apparatus via the drive force transmission mechanism relative to a single rotary member (i.e., the photoconductor) and are transmitted to the other rotary members via the gear row. Therefore, within the process cartridge unit, the layout of the gear row is restricted by the positional relationship between image forming elements (the photoconductor, the developer bearing member, a charging device, a development device, a cleaning device, etc.), and further, the space occupied by the drive force transmission mechanism within the process cartridge unit is relatively large.

SUMMARY OF THE INVENTION

The present invention has been made in view of the above-discussed and other problems and addresses the above-discussed problems and other problems.

Preferred embodiments of the present invention provide a novel process cartridge unit that can increase freedom in the layout of a drive force transmission mechanism and reduce the space required for the drive force transmission mechanism within the process cartridge unit. The preferred embodiments of the present invention in particular provide a novel process cartridge unit having at least two rotary members that is detachable relative to the main body of an image forming apparatus and is relatively simple in configuration.

According to an embodiment of the present invention, an image forming apparatus includes a unit including at least two rotary members, and an apparatus main body configured to detachably mount the unit. The apparatus main body includes a first rotational drive source, drive rotary members corresponding to the at least two rotary members and engaging with the at least two rotary members, directly or indirectly, to rotate the at least two rotary members, respectively, and a drive force transmission mechanism transmitting a drive force of the first rotation drive source to the drive rotary members.

Thus, in the above-described image forming apparatus, the drive force transmission mechanism transmitting the drive force of the first rotational drive source to the drive rotary members is provided at the side of the apparatus main body. Thereby, the space for the drive force transmission mechanism at the side of the unit can be decreased, so that the freedom in the layout of the elements in the unit is increased and the construction of the unit is simplified, and as a result, the maintainability of the unit is enhanced.

In the image forming apparatus, the drive force transmission mechanism may include a drive force transmission rotary member provided between the drive rotary members to transmit the drive force of the first rotation drive source to the drive rotary members.

Thus, with the provision of the drive force transmission rotary member between the drive rotary members, even when the distance between two rotary members is relatively far or the rotational speed is different between the two rotary members, the space for the drive force transmission mechanism at the side of the unit can be decreased and the construction of the unit can be simplified.

Further, in the image forming apparatus, the unit may include a second rotary member between two rotary members of the at least two rotary members, and the apparatus main body may include a second rotational drive source independent from the first rotational drive source, and a second drive rotary member driven by the second rotational drive source and engaging with the a second rotary member to rotate the second rotary member. The second rotary member may be an image bearing rotary member bearing an image, and the at least two rotary members may be any of a charging device charging a surface of the image bearing rotary member, a cleaning member cleaning a surface of the image bearing rotary member, and a development roller visualizing the image on the image bearing rotary member.

Thus, in the image forming apparatus, the image bearing rotary member is driven by the second rotational drive source that is independent from the first rotational drive source driving other rotary members. Thereby, the image bearing rotary member which is required to be driven at high accuracy most can be driven with a high degree of accuracy.

Furthermore, in the image forming apparatus, the unit may include a base member supporting one of the at least two rotary members, and a support member supporting other rotary members of the at least two rotary members. The support member is movable between an adjacent position and a separate position relative to the base member.

As described above, in the image forming apparatus, the drive force transmission mechanism transmitting the drive force of the first rotational drive source to the drive rotary members rotating the rotary members is provided at the side of the apparatus main body. Therefore, in moving the support member between the adjacent position and the separate position relative to the base member, there is no need for detaching or releasing a drive force transmission mechanism. Thereby, the possibility of deteriorating the accuracy in the drive force transmission, which may be caused by detaching or releasing of the drive force transmission mechanism, can be avoided.

According to another embodiment of the present invention, a process cartridge unit for an image forming apparatus is provided. The process cartridge unit includes at least two rotary members, a base member supporting one of the at least two rotary members, and a support member supporting other rotary members of the at least two rotary members. The support member is movable between an adjacent position and a separate position relative to the base member.

In the process cartridge unit, the rotational axes of the at least two rotary members may be directed in substantially the same direction, and the support member may be rotatable around an axis parallel to the rotational axes of the at least two rotary members to move relative to the base member.

Further, in the process cartridge unit, the support member may be configured to be detached from and attached to the base member.

Furthermore, in the process cartridge unit, the at least two rotary members may be any of an image bearing rotary member bearing an image, a charging device charging a surface of the image bearing rotary member, a cleaning member cleaning a surface of the image bearing rotary member, and a development roller visualizing the image on the image bearing rotary member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
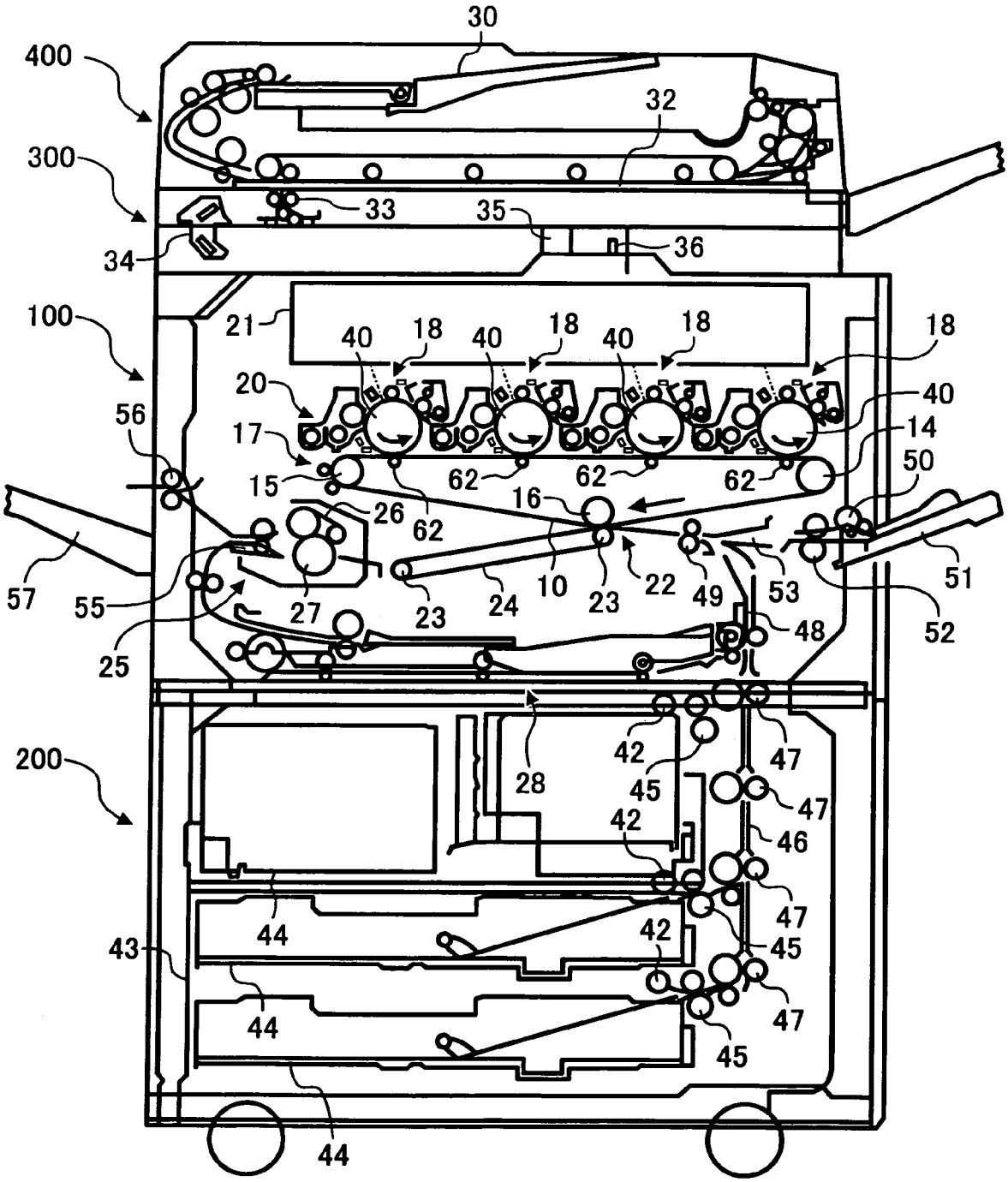
FIG. 1 is a diagram schematically illustrating an exemplary construction of a tandem-type image forming apparatus of an indirect transfer system according to an embodiment of the present invention.

Referring now to the drawings, wherein like reference numerals designate identical or corresponding parts throughout the several views.

FIG. 1 illustrates a tandem-type color copier of an indirect transfer system as an image forming apparatus according to an embodiment of the present invention. The present invention can be applied to a tandem-type color copier of a direct transfer system, a revolver-type color copier, and a black-and-white copier. In FIG. 1, reference number 100 denotes the main body of the color copier, reference number 200 denotes a sheet feed part on which the main body 100 is mounted, reference number 300 denotes a scanner mounted on the main body 100, and reference number 400 denotes an automatic original document feed device (ADF) mounted on the scanner 300.

An endless belt-type intermediary transfer member 10 is provided at the center of the main body 100. The intermediary transfer member 10 may be constructed by providing an elastic layer constituted of a fluorine rubber, an acrylonitrile-butadiene copolymer rubber, etc. on a base layer constituted of a material hard to be extended (e.g., a fluorocarbon resin, a canvas, etc.) and by forming a coat layer having good smoothness on the surface of the elastic layer by coating, for example, a fluorine-family resin. The intermediary transfer member 10 is spanned around first, second and third support rollers 14, 15 and 16, and is conveyed to rotate in the clockwise direction in FIG. 1.

An intermediary transfer member cleaning device 17 is arranged at the left side of the second support roller 15 to remove residual toner remaining on the intermediary transfer member 10 after transfer of an image. Four image formation devices 18 for black, yellow, magenta and cyan are arranged side-by-side along the conveying direction of the intermediary transfer member 10 above the part of the intermediary transfer member 10 spanned by and extended between the first support roller 14 and the second support roller 15, and thereby a tandem image formation device 20 is constructed. Further, an exposure device 21 is arranged above the tandem image formation device 20, and a secondary transfer device 22 is arranged at the opposite side of the intermediary transfer member 10 (opposite the side where the tandem image formation device 20 is arranged). The secondary transfer device 22 is constructed by spanning an endless secondary transfer belt 24 around two rollers 23, and is arranged to be pressed against the third support roller 16 via the intermediary transfer member 10. An image on the intermediary transfer member 10 is transferred onto a sheet passing through a nip part of the intermediary transfer member 10 and the secondary transfer belt 24.

A fixing device 25 is provided next to the secondary transfer device 22 to fix the transferred image onto the sheet. The fixing device 25 is constructed by pressing a pressure roller 27 against an endless fixing belt 26. The secondary transfer device 22 conveys the sheet passed through the nip part of the intermediary transfer member 10 and the secondary transfer belt 24 carrying the transferred image thereon to the fixing device 25. A non-contact type charger may be used for the secondary transfer device 22. In this case, a sheet conveying device may be arranged to convey the sheet passed through the nip part of the intermediary transfer member 10 and the secondary transfer belt 24 to the fixing device 25.

A sheet reverse device 28 is arranged below the secondary transfer device 22 and the fixing device 25 is arranged to be parallel to the tandem image formation device 20 to reverse the sheet carrying the transferred image thereupon (on one side of the sheet) so that another image is transferred onto the other side of the sheet.

When obtaining a copy of an original document using the above-described color copier, the original document is set on an original document plate 30 of the ADF 400, or the original document is set on a contact glass 32 of the scanner 30 by opening the ADF 400 and is then pressed against the contact glass 32 by closing the ADF 400. By depressing a start button (not shown), when the original document has been set on the ADF 400, the scanner 300 is driven after conveying the original document onto the contact glass 32, and when the original document has been set on the contact glass 32, the scanner 300 is driven immediately, and a first travel member 33 and a second travel member 34 are driven to move. The first travel member 33 emits a light, and reflects a reflected light from the surface of the original document toward the second travel member 34. A mirror of the second travel member 34 reflects the light reflected from the surface of the original document toward an image formation lens 35. The light passes the image formation lens 35 and is received by a reading sensor 36, and thereby the image information of the original document is read with the reading sensor 36.

When the start button is depressed, a drive motor (not shown) drives one of the support rollers 14, 15 and 16 to rotate, and thereby the other two support rollers are driven, and thereby the intermediary transfer member 10 is conveyed to rotate. At the same time, the photoconductors 40 of the image formation devices 18 are rotated, and a black image, a yellow image, a magenta image, and a cyan image are formed thereupon, respectively. As the intermediary transfer member 10 is conveyed, these images are sequentially transferred onto the intermediary transfer member 10 to be superimposed on top of each other, so that a full color image is formed on the intermediary transfer member 10.

When the start button is depressed, one of feed rollers 42 of the sheet feed part 200 is selectively rotated to feed a sheet from one of sheet cassettes 44 provided in a multistage paper bank 43. The sheet is fed out one by one by a separation roller 45 from the sheet cassette 44 to be conveyed to a sheet feed path 46. The sheet is conveyed by convey rollers 47 to a feed path 48 in the main body 100, and impinges on a registration roller 49 to be stopped. When manually inserting a sheet from a manual insertion table 51, by rotating a feed roller 50, the inserted sheet is conveyed by the feed roller 50 and is conveyed one by one by a separation roller 52 to a manual sheet conveying path 53. The sheet similarly impinges on the registration roller 49 to be stopped.

The registration roller 49 is rotated in synchronism with the full color image on the intermediary transfer member 10, and the sheet is conveyed into the nip part of the intermediary transfer member 10 and the secondary transfer belt 24 of the secondary transfer device 22. The color image on the intermediary transfer member 10 is transferred onto the sheet by the secondary transfer device 22, so that the color image is formed on the sheet. The sheet is then conveyed to the fixing device 22 by the secondary transfer device 22. The fixing device 25 fixes the color image onto the sheet by applying heat and pressure. Thereafter, a switch claw 55 switches the direction in which the sheet is conveyed toward a discharger roller pair 56 so that the sheet is discharged onto a discharge tray 57 or toward the sheet reverse device 28. The sheet conveyed to the sheet reverse device 28 is reversed, and is guided to the nip part of the intermediary transfer member 10 and the secondary transfer belt 24 of the secondary transfer device 22. After an image is formed on the other side of the sheet, the sheet is discharged onto the discharge tray 57 by the discharge roller 56.

Residual toner remaining on the intermediary transfer member 10 after transferring the color image onto the sheet is removed by the intermediary transfer member cleaning device 17 so that the intermediary transfer member 10 is ready for next image formation by the tandem image formation device 20.

Figure 2:
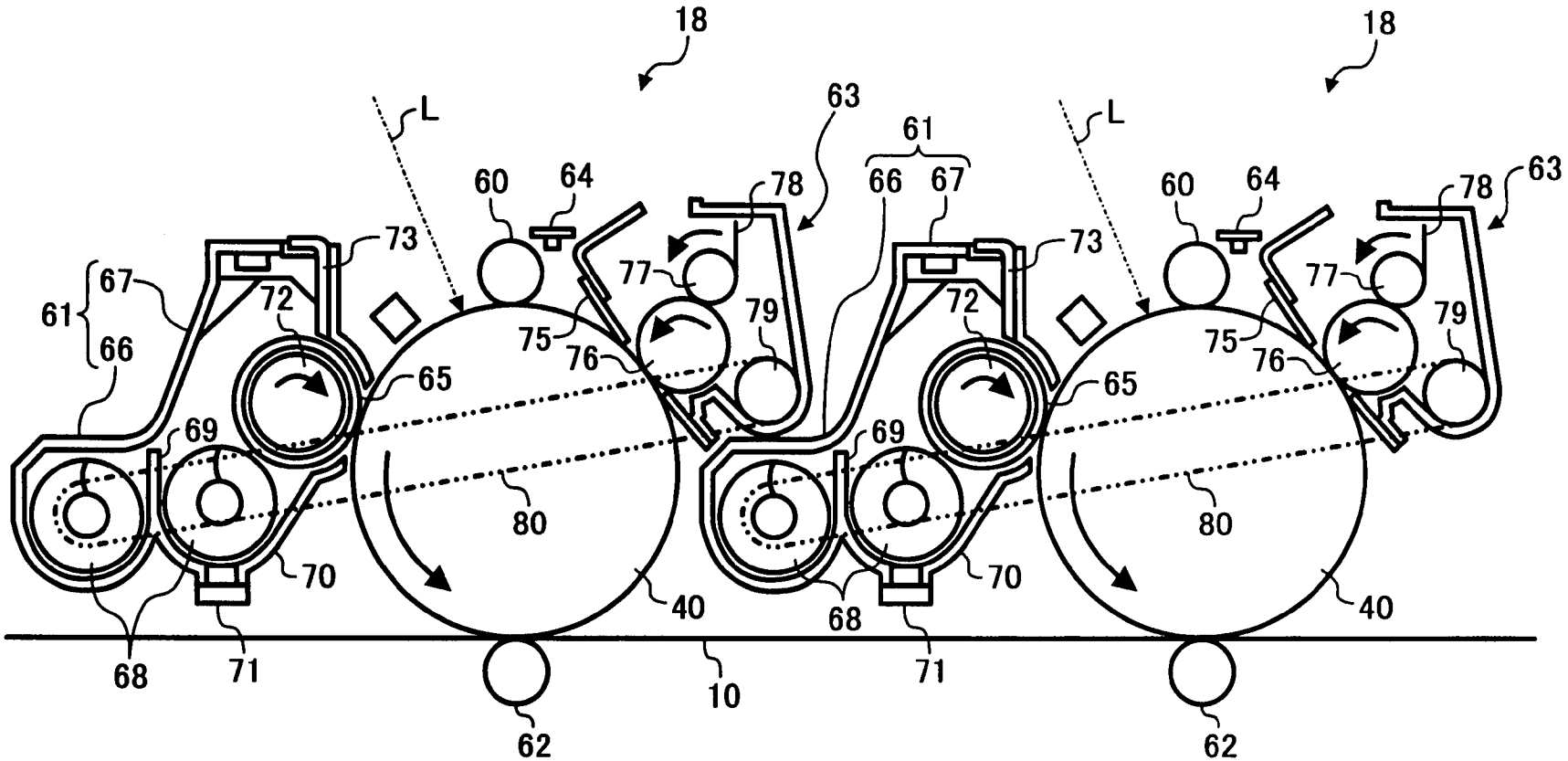
FIG. 2 is a diagram schematically illustrating details of an image formation device of the image forming apparatus.

FIG. 2 illustrates details of each image formation device 18. The image formation device 18 includes, as illustrated in FIG. 2, a charging device 60, a development device 61, a first transfer device 62, a photoconductor cleaning device 63, and a discharging device 64, which are arranged around the photoconductor 40 formed in a drum shape. The photoconductor 40 is constituted by forming a photosensitive layer by coating an organic photoconductive material on a drum made of aluminum. The photoconductor 40 may be formed in an endless belt.

In the illustrated example, the charging device 60 is formed in a roller shape, and is arranged to contact the photoconductor 40. By applying a voltage to the charging device 60, the photoconductor 40 is charged by the charging device 60. The development device 61 uses a two-component developer including magnetic carriers and non-magnetic toner. A single component developer may be also used. The development device 61 includes a stirring part 66 to stir and convey the two-component developer to a development roller (sleeve) 65 so that the developer adheres to the development roller 65, and a development part 67 to transfer toner of the two-component developer adhered to the development roller 65 onto the photoconductor 40. The stirring part 66 is positioned lower than the development part 67. The stirring part 66 includes two parallel screws 68, which are separated from each other by a separation plate 69 except end parts of the screws 68. A toner density sensor 71 is provided in a development case 70. The development roller 65 is arranged to face the photoconductor 40 via an opening of the development case 70. A magnet 72 is fixedly provided in the development roller 65. Further, a doctor blade 73 is provided such that a tip of the blade 73 is close to the surface of the development roller 65.

The toner in the developer formed in a magnetic brush form on the development roller 65 is transferred to the photoconductor 40 by a development bias voltage applied to the development roller 65, and thereby an electrostatic latent image on the photoconductor 40 is visualized with the toner. The developer remaining on the development roller 65 after visualization separates from the development roller 65 in an area where the magnetic force of the magnet 72 does not exist and returns to the stirring part 66. When the toner density in the stirring part 66 has been decreased as a result of repeating the above-described visualization, the toner density sensor 71 detects the density, and toner is replenished to the stirring part 66.

The first transfer device 62 is formed in a roller shape and is pressed against the photoconductor 40 while sandwiching the intermediary transfer member 10. The first transfer device 62 may be a non-contact type corona charger. The photoconductor cleaning device 63 includes a cleaning blade 75, which is made of, for example, a polyurethane rubber, and is configured such that a tip end thereof is pressed against the photoconductor 40, and a photoconductive fur brush (or roller) 76, which is freely rotatable in the arrow direction while the outer circumferential surface thereof contacting the photoconductor 40. A metal roller 77, which is freely rotatable in the arrow direction, is arranged to contact the fur brush 76 to apply a bias voltage, and a tip end of a scraper 78 is pressed against the metal roller 77. Further, a collecting screw 79 is provided to collect removed toner. The toner collected in the photoconductor cleaning device 63 is conveyed toward one side of the photoconductor cleaning device 63 by the collecting screw 79, and is returned to the development device 61 by a toner recycle device 80 for reuse. The discharging device 64 may be, for example, a lamp, and initializes the surface potential of the photoconductor 40 by illuminating a light onto the surface of the photoconductor 40.

With the rotation of the photoconductor 40, the charging device (roller) 60 uniformly charges the surface of the photoconductor 40, and then the exposure device 21 illuminates a writing light L according to the content read by the scanner 300 onto the surface of the photoconductor 40, and thereby an electrostatic latent image is formed on the photoconductor 40. Thereafter, by causing toner to be adhered to the electrostatic latent image with the development device 61, the latent image is visualized. The visualized image is then transferred onto the intermediary transfer member 10 by the first transfer device 62. Residual toner remaining on the surface of the photoconductor 40 is removed by the photoconductor cleaning device 63, and the discharging device 64 discharges the surface of the photoconductor 40.

Figure 3:
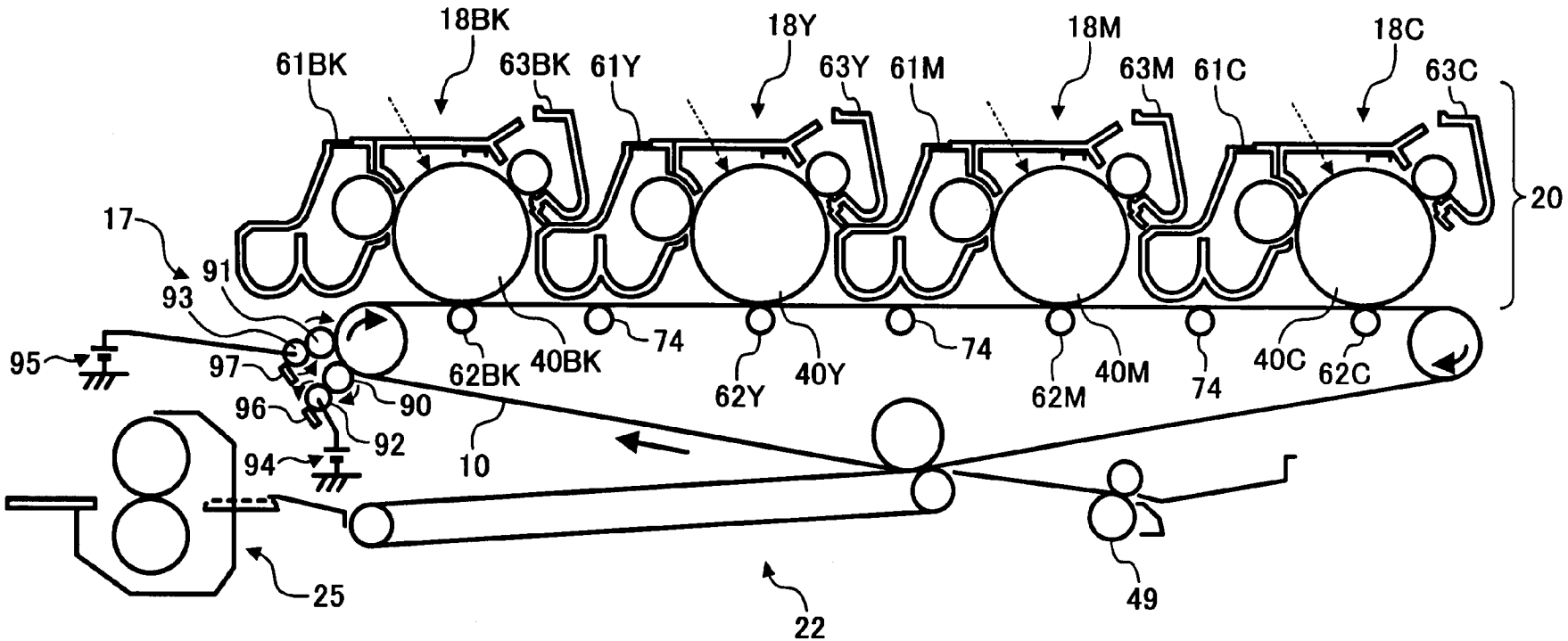
FIG. 3 is an enlarged view of the main part of the image forming apparatus.

FIG. 3 is an enlarged view of the main part of the color copier. In FIG. 3, "BK", "Y", "M", and "C" are appended to the reference symbols for the image formation devices 18, the photoconductors 40, the development devices 61, the photoconductor cleaning devices 63, and the first transfer devices 62 for black, yellow, magenta, and cyan, respectively. In FIG. 3, reference number 74 denotes a conductive roller arranged between respective first transfer devices 62 to contact the base layer of the intermediary transfer member 10. The conductive roller 74 prevents a bias voltage, which is applied by each first transfer device 62 when transferring an image, from being communicated to the adjacent image formation device 18 via the base layer of the intermediary transfer member 10.

Two fur brushes 90 and 91 are provided in the intermediary transfer member cleaning device 17. The fur brushes 90 and 91 are arranged to contact the intermediary transfer member 10 and to rotate in the opposite directions relative to the intermediary transfer member 10. Bias voltages different in polarity are applied to the fur brushes 90 and 91 by a power source (now shown). Metal rollers 92 and 93 are arranged to contact the fur brushes 90 and 91 and to rotate in the same directions as the fur brushes 90 and 91, respectively. A minus voltage is applied to the metal roller 92 at the upstream side in the direction in which the intermediary transfer member 10 is conveyed by an electric source 94, and a plus voltage is applied to the metal roller 93 at the downstream side by an electric source 95. Blades 96 and 97 are arranged such that respective tip ends press the metal rollers 92 and 93. With the rotation of the intermediary transfer member 10 in the arrow direction in FIG. 3, the surface of the intermediary transfer member 10 is first cleaned by the fur brush 90 by applying a minus voltage, and thereby excess toner on the intermediary transfer member 10 is moved to the fur brush 90. The toner is further moved from the fur brush 90 to the metal roller 92 by an electric potential difference, and the toner is scraped off the metal roller 92 by the blade 96. Toner still remaining on the intermediary transfer member 10 is charged to the minus voltage by the minus voltage applied by the fur brush 90. The intermediary transfer member 10 is then cleaned using the fur brush 91 by applying a plus bias voltage, and thereby the remaining toner is removed. The removed toner is moved from the fur brush 91 to the metal roller 93 by an electric potential difference, and the toner is scraped off the metal roller 93 by the blade 97. The toner scraped off by the blades 96 and 97 is collected into a tank (not shown). The collected toner may be recycled to the development device 61 using a toner recycle device. Toner still remaining on the intermediary transfer member 10 is moved to the photoconductor 10BK at the first transfer position for black and is collected by the photoconductor cleaning device 63BK.

Figure 4:
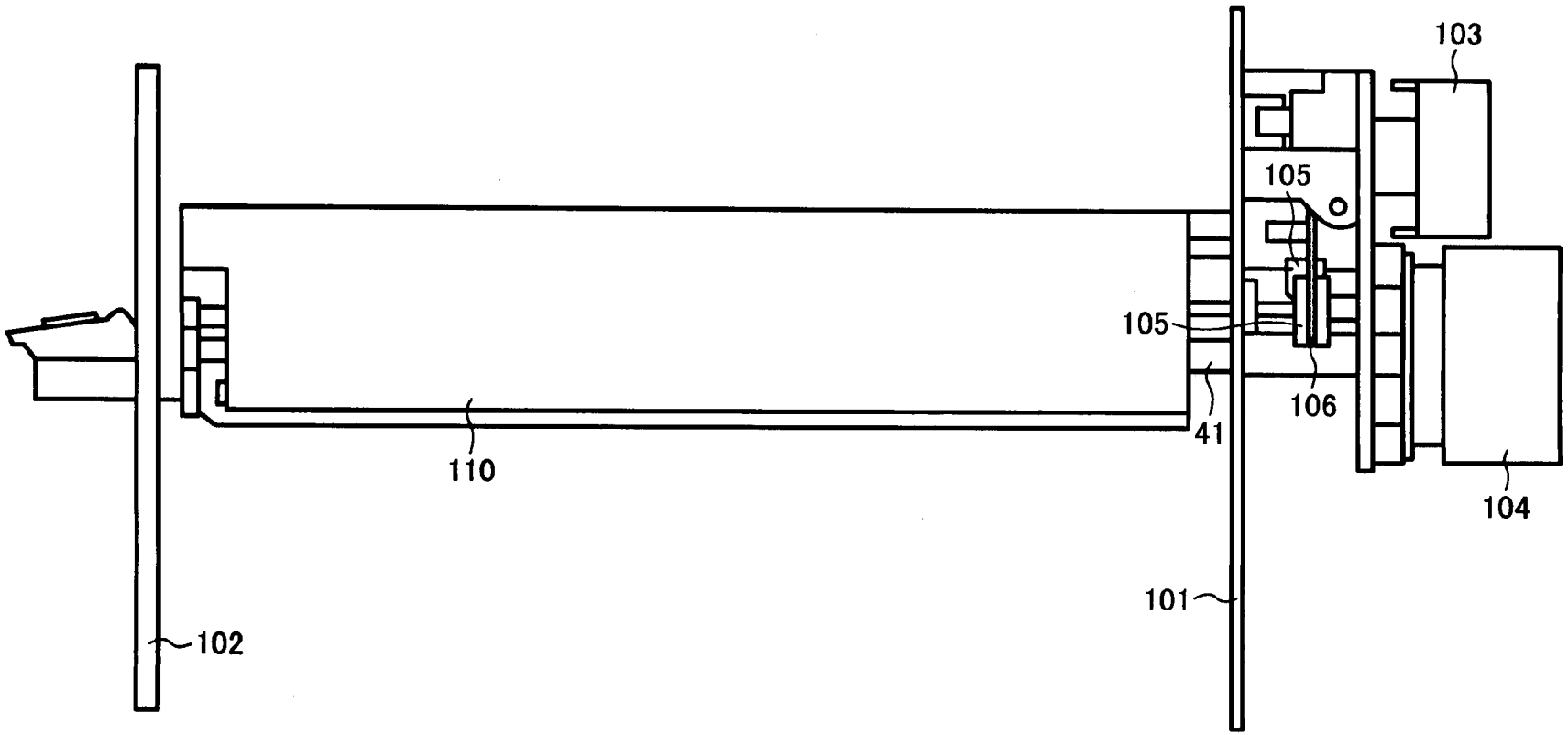
FIG. 4 is a diagram illustrating a process cartridge unit mounted to the main body of the image forming apparatus, and a drive force transmission mechanism of the main body.

FIG. 4 illustrates a process cartridge unit (hereinafter referred to as a PCU) 110 mounted to the main body 100, and a drive force transmission mechanism of the main body 100. The PCU 110 is attached to and detached from a photoconductor drive axis 41 and a main body rear side plate 101 of the main body 100. A main body front side plate 102 at the opposite side of the main body rear side plate 101 via the PCU 110 is easily detachable from the main body 100. Thereby, the PCU 110 can be easily attached to and detached from the main body 100. A drive mechanism including a development motor 103 (serving as a first rotation drive source), a photoconductor motor 104 (serving as a second rotation drive source), idler gears 105, a timing belt 106 (serving as a drive force transmission rotary member), etc. is provided to the main body rear side plate 101.

Figure 5A:
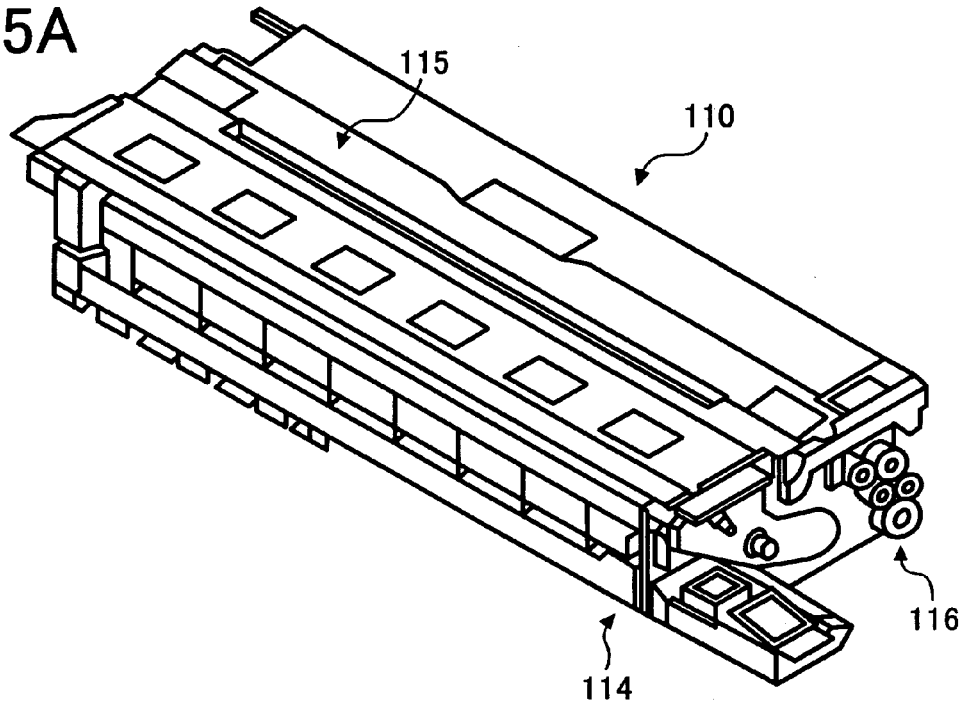
FIG. 5A is a perspective view of the process cartridge unit.
Figure 5B:
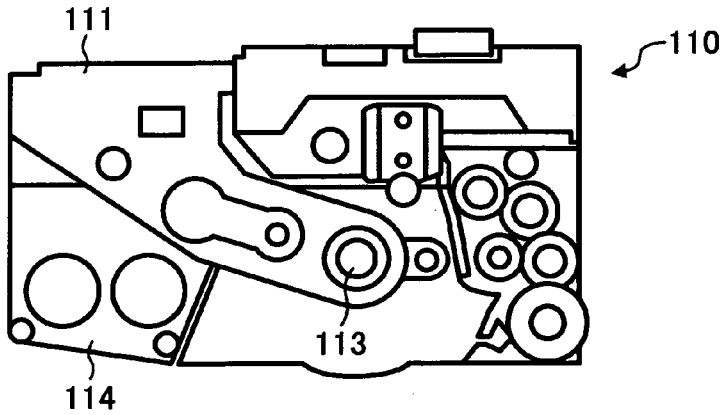
FIG. 5B is a front view of the process cartridge unit when viewed from the front side of the main body of the image forming apparatus.
Figure 5C:
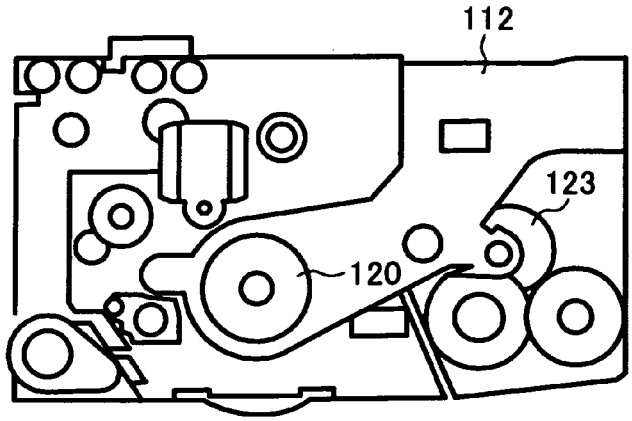
FIG. 5C is a back view of the process cartridge unit when viewed from the backside of the main body of the image forming apparatus.

FIG. 5A is a perspective view of the PCU 110, FIG. 5B is a front view of the PCU 110 when viewed from the front side of the main body of the color copier, and FIG. 5C is a rear view of the PCU 110 when viewed from the backside of the main body of the color copier. The PCU 110 is constituted by integrally arranging a development unit 114, a charging unit 115, and a cleaning unit 116 around the photoconductor 40 between a PCU front side plate 111 and a PCU rear side plate 112. In FIG. 5B, a drum drive axis bearing 113 is illustrated, and in FIG. 5C, a photoconductor drive axis engaging gear 120 and a development unit gear 123 are illustrated.

Figure 6:
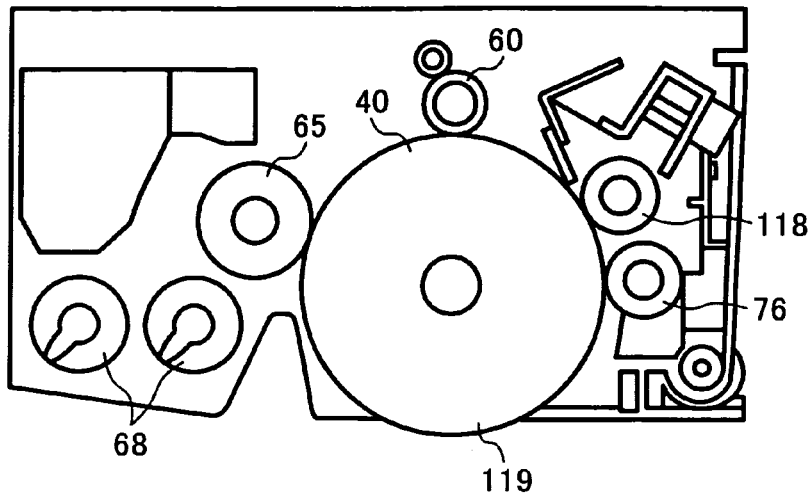
FIG. 6 is a cross section of the process cartridge unit.

FIG. 6 is a cross section of the PCU 110. As can be understood from FIG. 6, such rotary members as the photoconductor 40, the development roller 65, the charging roller 60, and the fur brush 76 and a cleaning roller 118 of the photoconductor cleaning device 63 are integrated with each other in the PCU 110. The cleaning roller 118 is provided to increase the cleaning efficiency. The cleaning roller 118 is omitted in FIG. 1, FIG. 2, and FIG. 3, and may be omitted in FIG. 6.

Figure 7A:
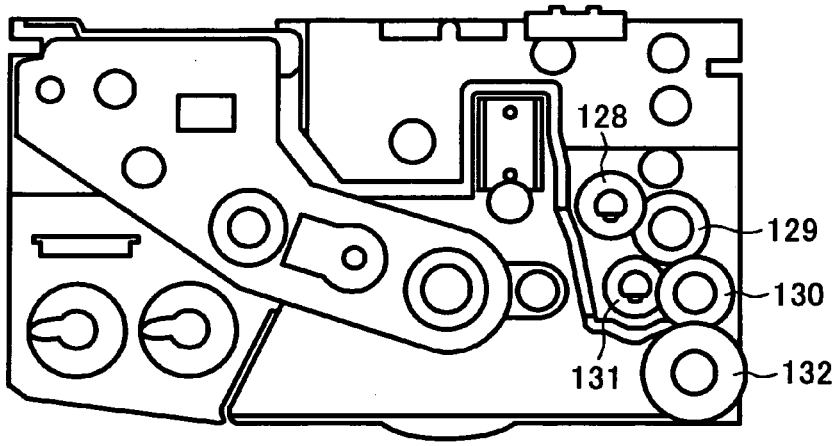
FIG. 7A is a front view of the process cartridge unit when viewed from the front side of the main body of the image forming apparatus for explaining a drive force transmission mechanism in the process cartridge unit.
Figure 7B:
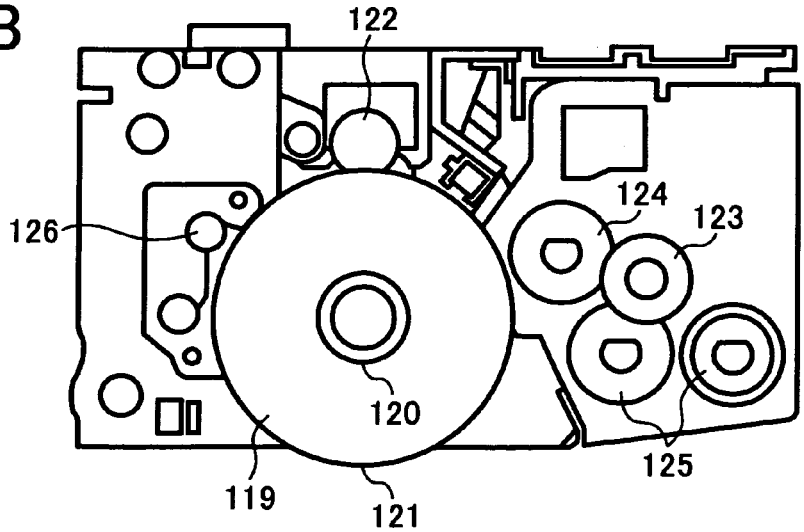
FIG. 7B is a back view of the process cartridge unit when viewed from the backside of the main body for explaining the drive force transmission mechanism in the process cartridge unit.

FIG. 7A and FIG. 7B are diagrams for explaining a drive force transmission mechanism in the PCU 110. FIG. 7A is a front view of the PCU 110 (with the PCU front side plate 111 removed) when viewed from the front side of the main body 100, and FIG. 7B is a back view of the PCU 110 (with the PCU rear side plate 112 removed) when viewed from the backside of the main body 100. FIG. 7A corresponds to FIG. 5B, and FIG. 7B corresponds to FIG. 5C, respectively. The drive force for the photoconductor 40 is transmitted to the photoconductor 40 from the photoconductor drive axis 41 (FIG. 4) via the photoconductor drive axis engaging gear 120 engaging with the photoconductor drive axis 41. The drive force for the charging device (roller) 60 is transmitted to the charging device (roller) 60 from a charging roller gear 121 provided to the outer circumferential surface of a photoconductor flange 119 via a charging roller gear 122 contacting the outer circumferential surface of the photoconductor flange 119. The drive force for the development unit 114 is transmitted thereto from a development unit drive input gear 135 serving as a drive rotary member (FIG. 8), which is provided at the side of the main body 100, via a development unit gear 123, a development roller gear 124, and development screw gears 125, which are provided at the rear side of the PCU 110. The drive force for the cleaning unit 116 is transmitted thereto from a cleaning unit drive input coupling ring 136 serving as a drive rotary member (FIG. 8), which is provided at the side of the main body 100, via a cleaning unit coupling 148 (FIG. 9B) provided at the rear side of the PCU 110 and engaging with a cleaning roller axis 126, a cleaning roller gear 128 provided at the front side of the PCU 110, cleaning idler gears 129 and 130, a fur brush gear 131, and a cleaning convey screw gear 132.

Figure 8:
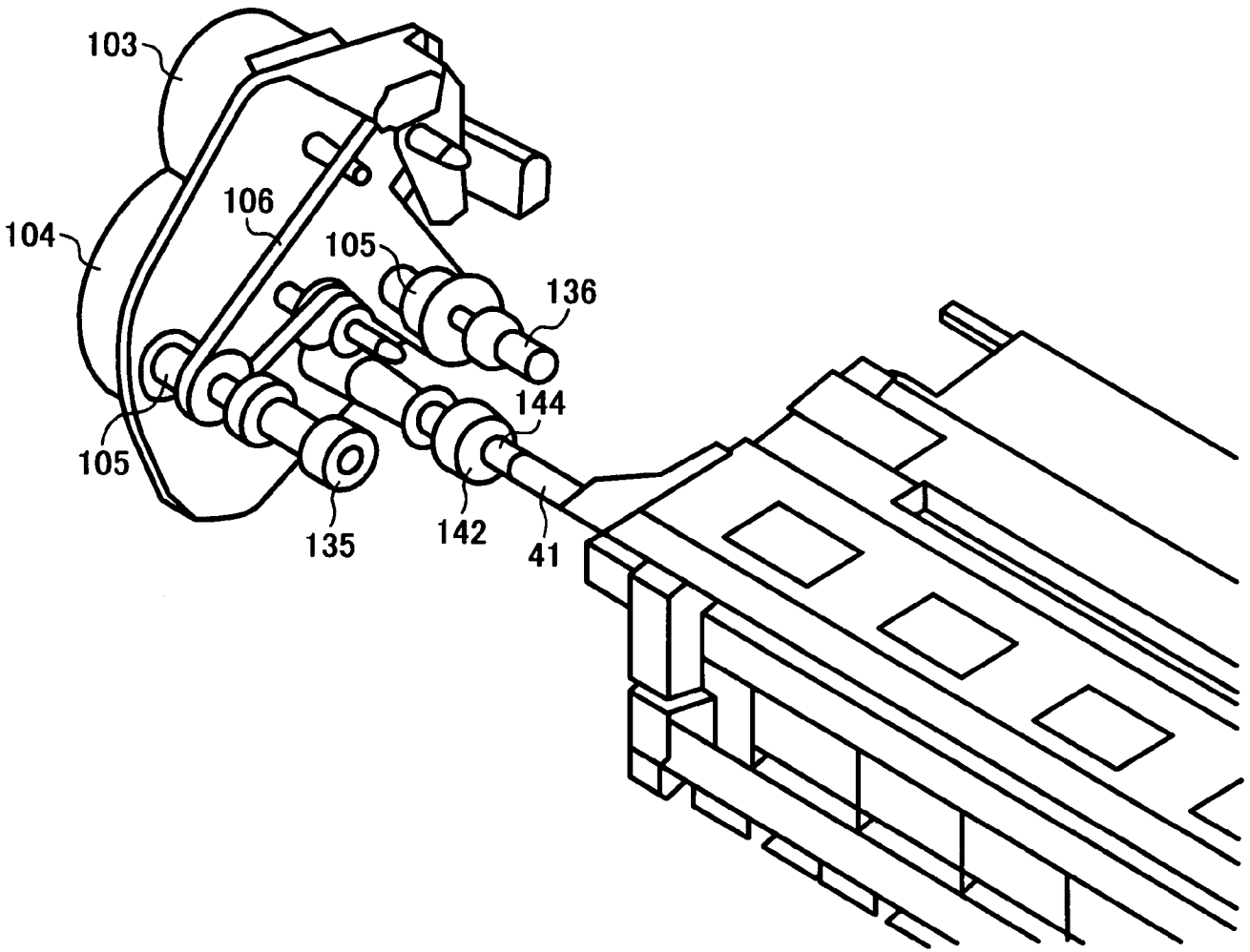
FIG. 8 is a diagram for explaining a drive mechanism of the main body of the image forming apparatus.

FIG. 8 is a view for explaining a drive mechanism of the main body 100. The photoconductor motor 104 transmits a drive force to the photoconductor drive axis 41. The photoconductor drive axis 41 is directly connected with the photoconductor motor 104, and a PCU rear side plate engaging bearing 142 and a photoconductor flange engaging part 144 are pressed into the photoconductor drive axis 41. The development motor 103 transmits a drive force to a development unit drive input gear 135 and a cleaning unit drive input coupling 136 via the idler gears 105 and the timing belt 106.

Figure 9A:
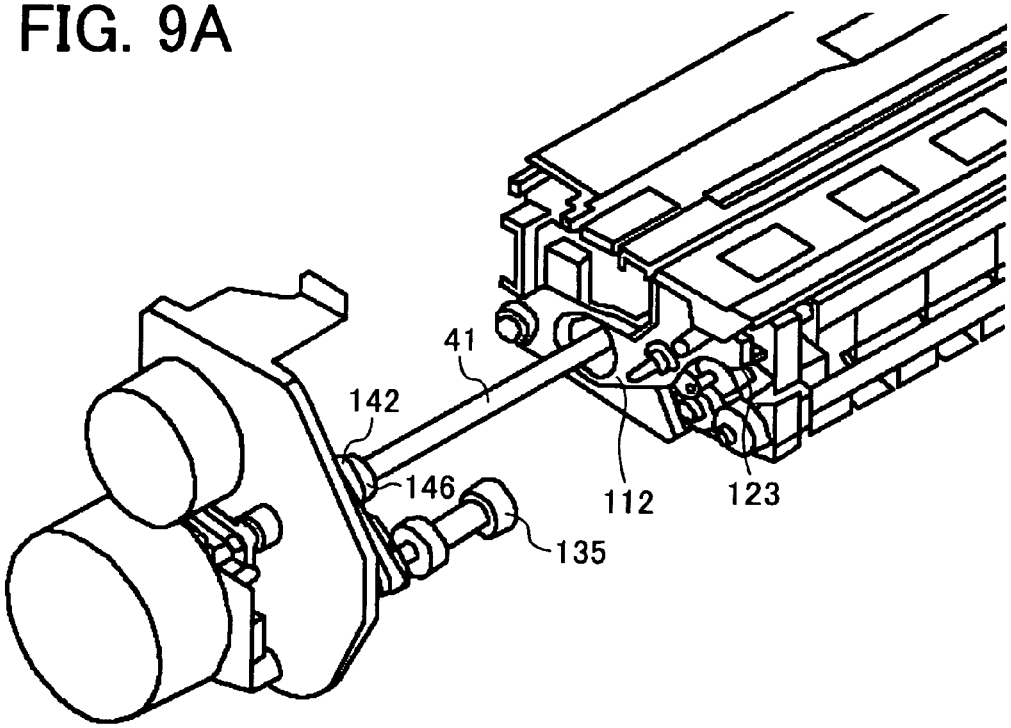
FIG. 9A is a diagram for explaining the drive connection between the process cartridge unit and the main body at the side of a development unit.
Figure 9B:
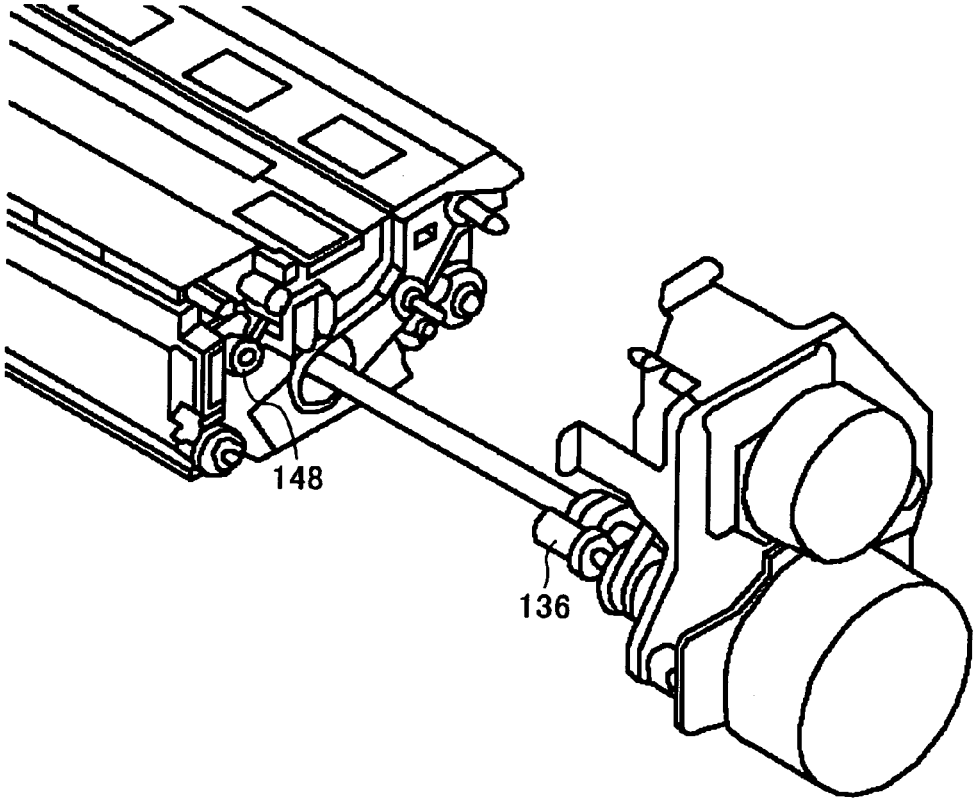
FIG. 9B is another diagram for explaining the drive connection between the process cartridge unit and the main body at the side of a cleaning unit.

FIG. 9A and FIG. 9B are diagrams for explaining the drive connection between the PCU 110 and the main body 100. FIG. 9A is a diagram for explaining the drive connection at the side of the development unit 114, and FIG. 9B is a diagram for explaining the drive connection at the side of the cleaning unit 116. The PCU 110 is detachable in the longitudinal direction of the photoconductor drive axis 41. The PCU rear side plate 112 engages with the PCU rear side plate engaging bearing 142 provided to the photoconductor drive axis 41, a photoconductor flange engaging gear 146 engages with the photoconductor drive axis engaging gear 120 (FIG. 7B), the development unit drive input gear 135 engages with the development unit gear 123, and the cleaning unit drive input coupling 136 engages with the cleaning unit coupling 148 at the front side of the main body 100. In this embodiment, the photoconductor motor 104 drives the charging device (roller) 60, however, the charging device (roller) roller 60 may be driven by the development motor 103.

The PCU 110 is configured such that support frame members supporting the cleaning unit 116 and the charging unit 115, respectively, open and close in a detachable manner relative to a base support frame member supporting the photoconductor 40.

Figure 10:
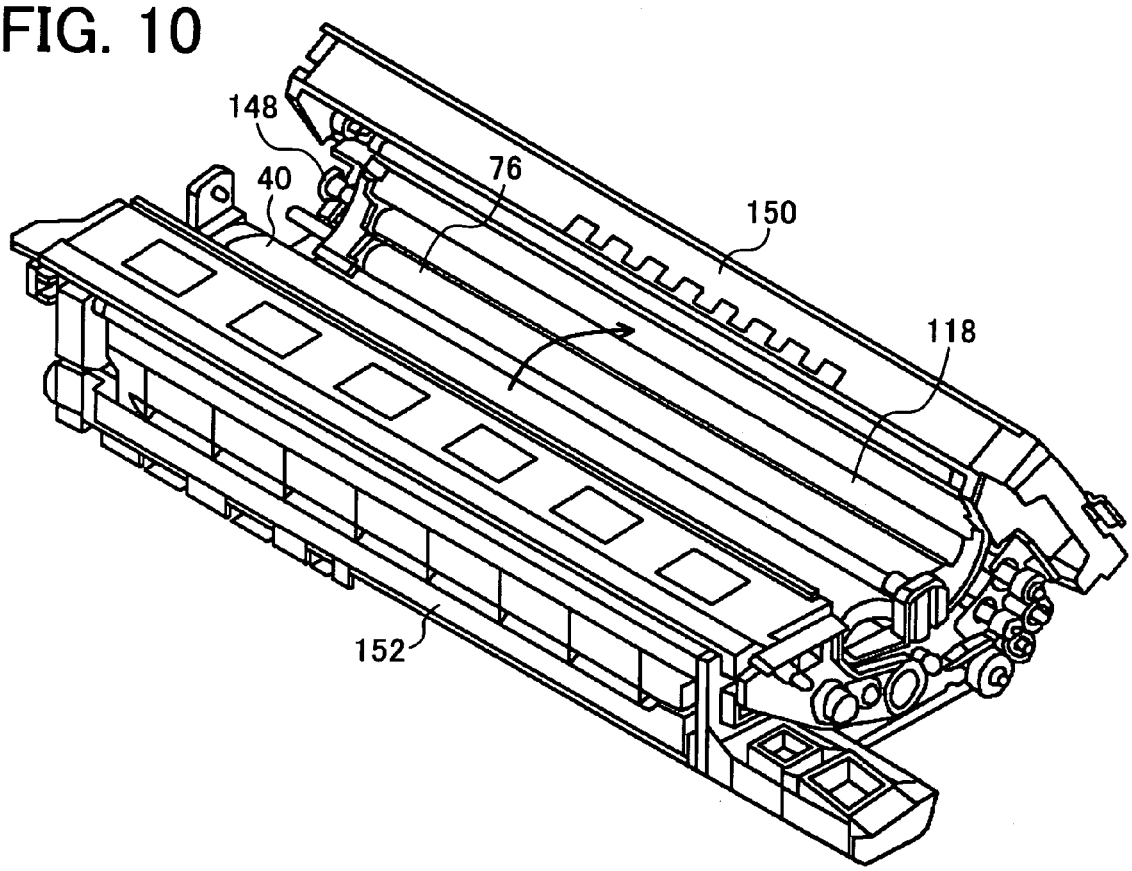
FIG. 10 is a diagram for explaining that the cleaning unit support frame member is rotatable relative to a photoconductor support frame member.

FIG. 10 is a diagram for explaining that a cleaning unit support frame member 150 supporting the cleaning unit 116 is rotatable relative to a photoconductor support frame member 152 supporting the photoconductor 40 as a base member. The cleaning unit support frame member 150 is rotatable in the clockwise direction in FIG. 10 relative to the photoconductor support frame member 152. Thereby, the photoconductor 40, and the fur brush 76 and the cleaning roller 118 of the cleaning unit 116 can be easily replaced.

Figure 11:
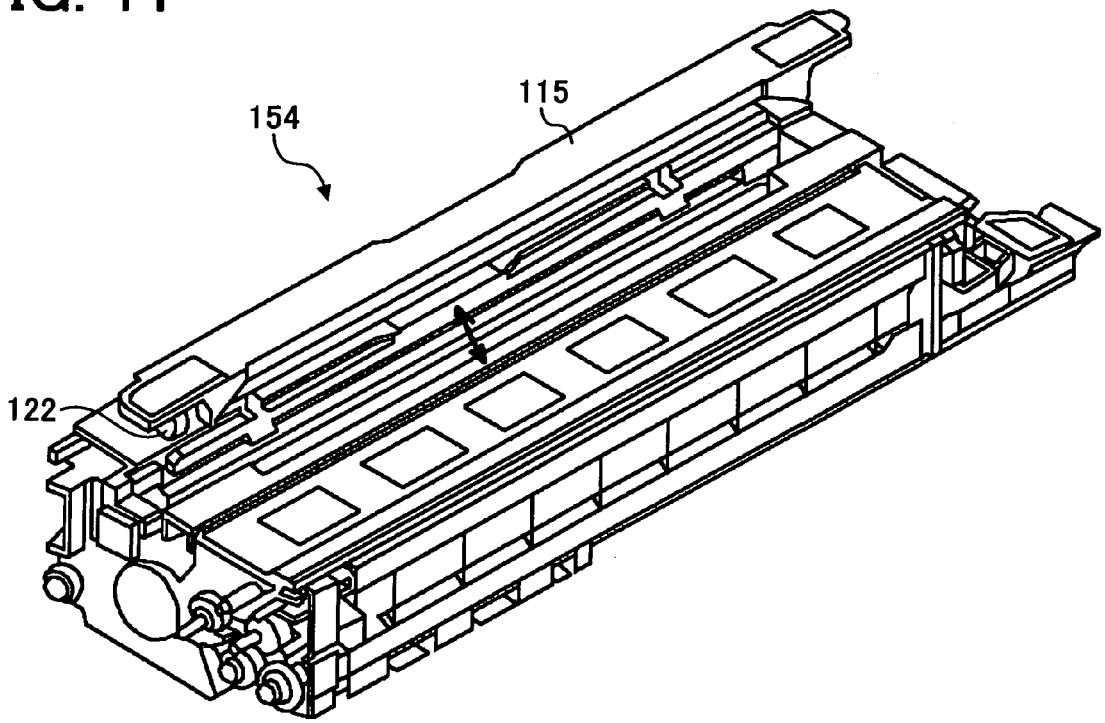
FIG. 11 is a diagram for explaining that the charging unit support frame member is detachable relative to the photoconductor support frame member.

FIG. 11 is a diagram for explaining that a charging unit support frame member 154 supporting the charging unit 115 is detachable relative to the photoconductor support frame member 152. The charging unit support frame member 154 supporting the charging unit 115 is moved in the upward and downward directions in the figure so as to be detached from and attached to the photoconductor support frame 152, and can be easily detached from the photoconductor support frame 152.

Figure 12:
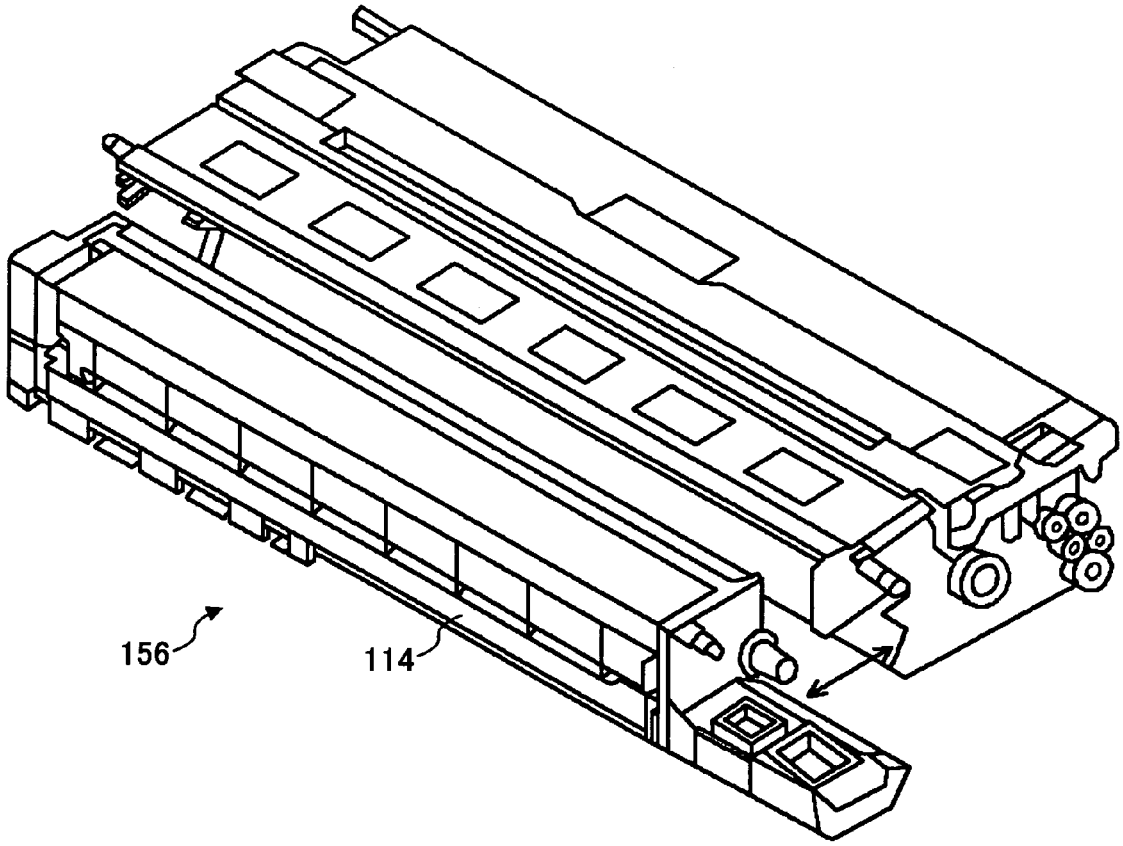
FIG. 12 is a diagram for explaining that the development unit support frame member is detachable relative to the photoconductor support frame member.

FIG. 12 is a diagram for explaining that a development unit support frame member 156 supporting the development unit 114 is detachable relative to the photoconductor support frame member 152. The development unit support frame member 156 supporting the development unit 114 is moved in the rearward and forward directions in the figure so as to be detached from and attached to the photoconductor support frame member 152, and can be easily detached from the photoconductor support frame member 152.

Numerous additional modifications and variations of the present invention are possible in light of the above-teachings. It is therefore to be understood that within the scope of the claims, the present invention can be practiced otherwise than as specifically described herein.

What is claimed is:

1. An image forming apparatus comprising:

a unit including at least two rotary members; and an apparatus main body configured to detachably mount the unit, the apparatus main body including a first rotational drive source, drive rotary members corresponding to the at least two rotary members and engaging with the at least two rotary members, directly or indirectly, to rotate the at least two rotary members, respectively, and a drive force transmission mechanism transmitting a drive force of the first rotation drive source to the drive rotary members, wherein the unit includes another rotary member between two rotary members of the at least two rotary members, and wherein the apparatus main body includes a second rotational drive source integrally mounted to said unit having said at least two rotary units independent from the first rotational drive source, and a second drive rotary member driven by the second rotation drive source and engaging with the second rotary member to rotate the second rotary member.

2. The image forming apparatus according to claim 1, wherein the drive force transmission mechanism includes a drive force transmission rotary member provided between the drive rotary members to transmit the drive force of the first rotational drive source to the drive rotary members.

3. The image forming apparatus according to claim 1, wherein the second rotary member is an image bearing rotary member bearing an image, and the at least two rotary members are any of a charging device charging a surface of the image bearing rotary member, a cleaning member cleaning a surface of the image bearing rotary member, and a development roller visualizing the image on the image bearing rotary member.

4. The image forming apparatus according to claim 1, wherein the unit includes a base member supporting one of the at least two rotary members, and a support member supporting other rotary members of the at least two rotary members, the support member being movable between an adjacent position and a separate position relative to the base member.

5. The image forming apparatus according to claim 4, wherein in the unit, rotation axes of the at least two rotation members are directed in a substantially same direction, and the support member is rotatable around an axis parallel to the rotation axes of the at least two rotation members to move relative to the base member.

6. The image forming apparatus according to claim 4, wherein in the unit, the support member is configured to be detached from and attached to the base member.

7. The image forming apparatus according to claim 4, wherein the rotary member of the at least two rotary members of the unit supported by the base member is an image bearing rotary member bearing an image, and the other rotary member of the at least two rotary members supported by the support member is selected from a group consisting of a charging device charging a surface of the image bearing rotary member, a cleaning member cleaning a surface of the image bearing rotary member, and a development roller visualizing the image on the image bearing rotary member.

* * * * *